US005399112A

United States Patent [19]

Bohlin et al.

[11] Patent Number: 5,399,112

[45] Date of Patent: Mar. 21, 1995

[54] SERVO ASSISTED CABLE STEERING MECHANISM, ESPECIALLY FOR BOATS

[75] Inventors: Stig Bohlin, Göteborg; Lennart Arvidsson, Kållered, both of Sweden

[73] Assignee: AB Volvo Penta, Goteborg, Sweden

[21] Appl. No.: 129,066

[22] PCT Filed: Apr. 3, 1992

[86] PCT No.: PCT/SE92/00218

§ 371 Date: Oct. 19, 1993

§ 102(e) Date: Oct. 19, 1993

[87] PCT Pub. No.: WO92/17369

PCT Pub. Date: Oct. 15, 1992

[30] Foreign Application Priority Data

Apr. 5, 1991 [SE] Sweden ..... 9101009

[51] Int. Cl.[6] ..... B63H 5/12

[52] U.S. Cl. ..... 440/62; 114/144 R; 440/61

[58] Field of Search ..... 440/53, 61, 62; 114/150, 144 R; 180/132, 150, 162, 163, 159; 91/462, 464, 466, 469, 431

[56] References Cited

U.S. PATENT DOCUMENTS 4,595,370 6/1986 Small ..... 440/62
4,744,777 5/1988 Ferguson ..... 440/61

FOREIGN PATENT DOCUMENTS 8902623 7/1989 Sweden .

*Primary Examiner*—Edwin L. Swinehart
*Attorney, Agent, or Firm*—Young & Thompson

[57] ABSTRACT

Servo-assisted cable steering arrangement, especially for boats, with an operating cable (4) connected to a steering wheel mechanism (1, 2) and displaceable in a casing (3). The outer end of the operating cable is joined to an operating rod (6) connected to a steering mechanism. The rod is displaceable in a guide tube (20) which is fixed to a valve tube (5), which is limitedly displaceable relative to and forms an operating element for a servo valve (8) of a hydraulic servo-unit in the form of piston cylinder device (10).

2 Claims, 2 Drawing Sheets

SERVO ASSISTED CABLE STEERING MECHANISM, ESPECIALLY FOR BOATS

FIELD OF THE INVENTION

The present invention relates to a servo-assisted steering arrangement comprising an operating cable connected to a steering wheel mechanism and displaceable in a casing, said operating cable having one end connected to an operating rod dispaceable in a rigid tube and connectable to a steering mechanism, and an hydraulic piston-cylinder device connected to a hydraulic pump via a servo valve and designed to be coupled to the steering mechanism, said servo valve having an operating element which can be acted on by the operating cable to activate the piston cylinder device and which comprises a tubular element limitedly displaceably relative to the servo valve housing

BACKGROUND OF THE INVENTION

In a known boat steering device of this type, the piston cylinder device, the servo valve and the tubular element which is limitedly displaceable form an integrated servo unit. The tubular element serving as an operating element for the servo valve forms in this case the rigid tube to which the operating cable casing is connected and which forms a guide for the operating rod.

Such a servo-assisted steering arrangement requires greater space athwartships (transversely to the boat) than a non-servo-assisted cable steering arrangement, due to the fact that the mounting of the cable casing in the guide tube of the operating rod is displaced when the cable with its operating rod is moved from its ordinary guide tube to the tubular element which is integrated with the servo valve of the servo-unit. This can create problems in boats in which the engine insulation is such that the space athwartships between for example a steering arm of a rudder or a steerable outboard drive-unit and the boat hull is limited. The reason that problems arise when the distance between the steering arm and the hull is small is that the radius of curvature of the operating cable will be small. This results, on the one hand, in increased friction between the cable and the casing and on the other hand to tensions which affects the control of the servo valve. Especially in boats with double engines with outboard drive units, in which the cable steering arrangement is connected to the steering arm of one of the drive units and is connected to the steering arm to the other drive unit via a tie rod, the space available can make it impossible to use a servo-unit of the type described.

OBJECTION OF THE INVENTION

The purpose of the present invention is to achieve a steering device of the type described by way of introduction which requires less space athwartships than the known device described above.

SUMMARY OF THE INVENTION

This is achieved according to the invention by virtue of the fact that the rigid tube is joined to the tubular element in a position parallell to the latter.

The invention is quite simply based on the idea of keeping the cable casing fixed to the ordinary guide tube and mounting said ordinary guide tube to the outside of the tubular operating element of the servo valve instead of moving said components from the guide tube to the tubular operating element of the servo valve. This means that the mounting of the cable casing can be closer to the centre of the engine, which in turn permits a greater radius of curvature for the operating cable.

BRIEF DESCRIPTION OF THE DRAWINGS

The invention will be described in more detail with reference to the accompanying drawings, where.

DETAILED DESCRIPTION OF THE PRIOR ART

Figure 1:
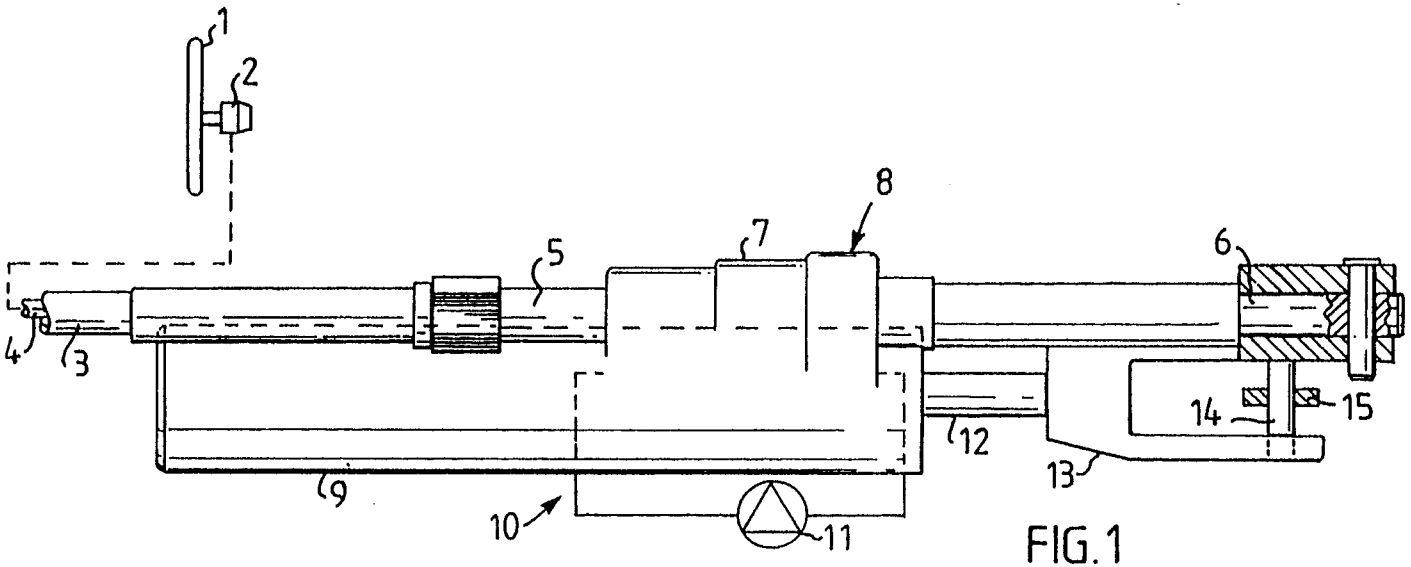
FIG. 1 (PRIOR ART)
FIG. 1 shows a sideview of a previously known servo-assisted steering device for boats and FIG. 2 shows a sideview of a preferred embodiment of steering device according to the invention.

In FIG. 1 designates a boat steering wheel which is connected to a transmission device 2, which upon turning the wheel displaces a cable 4 in its casing 3. The device 2 can be of any suitable type known per se as can the casing 3 of the cable 4, which form a common push-pull cable for steering the boat.

The cable casing is screwed securely to the end of a valve tube 5 forming the guide for an operating rod 6 joined to the cable 4.

The valve tube 5 extends through a valve housing 7 to a servo valve with the general designation 8. The valve housing 7 is made in one piece with a hydraulic cylinder 9 of a double acting piston cylinder device 10. The valve tube 5 is limitedly displaceable in the valve housing 7 and interacts with a valve slide (not shown), which regulates the supply of hydraulic fluid to one or the other cylinder chamber in the cylinder 9 from a motor driven hydraulic pump 11, depending on the position of the valve tube relative to the valve housing. The servo valve 8, the valve tube 5 and the piston cylinder device 10 form a unit which can be of a known type, such as that marketed by Showa Manufacturing Comp. Ltd and which thus does not need to be described in more detail here.

The operating rod 6 as well as the piston rod 12 of the piston cylinder device 10 is joined to a common connecting piece 13 with a pin 14 disposed in a bore in a steering arm 15 on the steering shaft for example of an outboard drive unit. When the steering wheel 1 is turned so that the operating rod 6 is displaced outwards, i.e. to the right in FIG. 1, the valve tube 5 is displaced to the left relative to the valve housing 7 due to the reactive force. A servo valve 8 thus opens conducting fluid into the left hand chamber of the cylinder 9 thereby displacing the piston rod 12 to the right. As long as the steering wheel is turned so that the operating rod 6 is loaded, the reactive force on the valve tube will cause fluid to be supplied to the cylinder serving as a servo unit. When the turning of the steering wheel stops, the servo valve 8 will close due to return flow between the operating rod 6 and the piston cylinder device.

DETAILED DESCRIPTION OF THE PREFERRED EMBODIMENT

Figure 2:
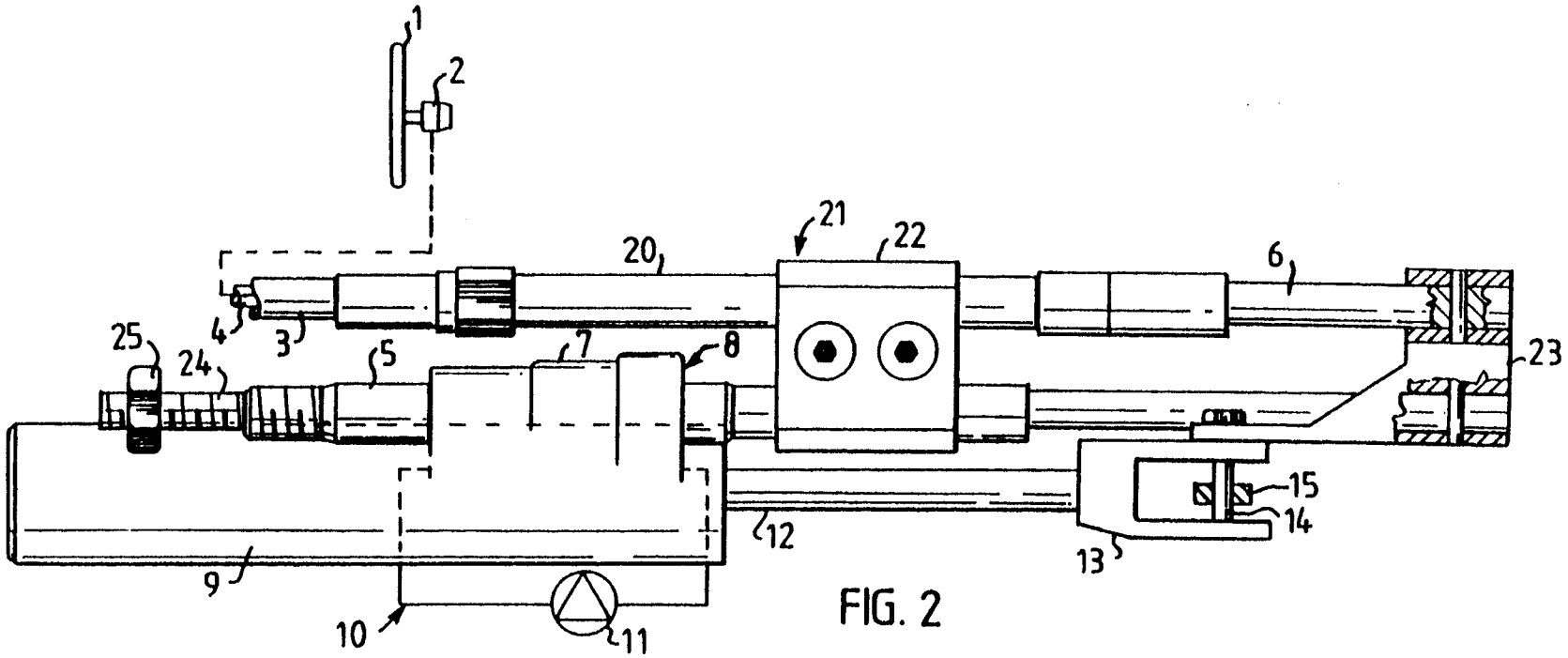

FIG. 2 shows a steering device according to the invention where components having counterparts in FIG. 1 have been given the same reference numerals as in FIG. 1. The device in FIG. 2 differs from that in FIG. 1 primarily in that the operating rod 6 is guided in a separate guide tube 20 to which the end of the cable casing 3 is securely screwed. The tube 20 is the ordinary tube for guiding the cable which is used for steering without a servo unit, and from which the casing 3 and the operating rod 6 are normally moved to the valve tube 5 of the servo unit when a servo unit is installed.

According to the invention the ordinary guide tube 20 is instead fixed to the valve tube 5 parallel thereto and to one side thereof with the aid of a clip 21 consisting of two halves 22 (one shown) which are screwed together to clamp between them the guide tube 20 and the valve tube 5. As can be seen in the Figures, this arrangement makes it possible to move the attachment point of the cable jacket 3 closer to the steering arm 15. In order to compensate for this lateral displacement, the outer end of the operating rod 6 is joined to an extension 23 which is fixed (e.g. screwed securely) to the connecting piece 13. By using a clip 21 of the type described, the guide tube 20 can be adjusted as needed in its longitudinal direction relative to the valve tube 5 to fit the insulation in question.

Through the valve tube 5 there extends a guide rod 24, which is fixed in one end to the extension piece 23, and extends with its other end out from the valve tube 5. It is threaded and provided with an adjustable end position nut 25, which makes it possible to determine the maximum steering angle.

We claim:

1. In a servo assisted steering device comprising an operating cable connected to a steering wheel mechanism and displaceable in a casing, said operating cable having one end connected to an operating rod displaceable in a rigid tube and connectible to a steering mechanism, and an hydraulic piston cylinder device connected to a hydraulic pump via a servo valve and designed to be coupled to the steering mechanism, said servo valve having an operating element which can be acted on by the operating cable to activate the piston cylinder device and which comprises a tubular element limitedly displaceable relative to the servo valve housing, said tubular element having a central bore adapted to support the operating rod and one end adapted to be connected to said casing; the improvement wherein the rigid tube (20) and the tubular element (5) are arranged side by side and are joined to each other and have spaced-apart parallel longitudinal axes.

2. Steering device according to claim 1, wherein in that the stationary tube (20) is adjustable in its longitudinal direction relative to the tubular element (5).

* * * * *